US008327573B1

(12) United States Patent
Cheng et al.

(10) Patent No.: US 8,327,573 B1
(45) Date of Patent: Dec. 11, 2012

(54) RIFLE SCOPE WITH INTEGRATED LASER SIGHT

(75) Inventors: Carson Cheng, City of Industry, CA (US); Jim Zhang, City of Industry, CA (US)

(73) Assignees: Carson Cheng, City of Industry, CA (US); Nantong Universal Optical Instrument Co., Ltd., Nantong, Jiagsu (CN)

( * ) Notice: Subject to any disclaimer, the term of this patent is extended or adjusted under 35 U.S.C. 154(b) by 0 days.

(21) Appl. No.: 13/134,625

(22) Filed: Jun. 10, 2011

(51) Int. Cl.
*F41G 1/38* (2006.01)

(52) U.S. Cl. ..... 42/115

(58) Field of Classification Search ..... 42/115, 42/146, 142; 33/277; 356/4.01
See application file for complete search history.

(56) References Cited

U.S. PATENT DOCUMENTS

| | | | | |
|---|---|---|---|---|
| 5,771,623 | A * | 6/1998 | Pernstich et al. | 42/115 |
| 5,903,996 | A * | 5/1999 | Morley | 42/115 |
| 2006/0010761 | A1 * | 1/2006 | Staley, III | 42/142 |

* cited by examiner

*Primary Examiner* — Michael Carone
*Assistant Examiner* — John D Cooper
(74) *Attorney, Agent, or Firm* — Raymond Y. Chan; David and Raymond Patent Firm

(57) ABSTRACT

A telescopic sighting device includes a tubular scope, an objective lens, an ocular assembly, and a laser locator. The objective lens is mounted at a bell portion of the tubular scope for focusing light at a focal point in the body portion of the tubular scope. The ocular assembly is provided at an eyepiece portion of the tubular scope for magnifying the light from focused at the focal point. Furthermore, the laser locator is mounted at the bell portion of the tubular scope at a position adjacent to the objective lens, and comprises a laser emitter arranged to generate a laser beam toward a target, in such a manner that a user is able to observe a laser indicator produced by the laser beam on the target through the ocular assembly so as to enhance an accuracy of locating the target by the telescopic sighting device.

20 Claims, 5 Drawing Sheets

RIFLE SCOPE WITH INTEGRATED LASER SIGHT

BACKGROUND OF THE PRESENT INVENTION

1. Field of Invention

The present invention relates to a sighting device, and more particularly to a telescopic sighting device which allows a user to directly observe a laser indicator through an ocular lens so as to maximize the accuracy of targeting an object.

2. Description of Related Arts

A conventional gun usually has a telescopic sight mounted thereon for allowing the shooter to locate the target. Conventionally, a telescopic sight comprises an elongated body having a bell portion accommodating an objective lens, an eyepiece portion accommodating an ocular lens, and a main portion extended between the bell portion and the eyepiece portion. In order to assist the shooter to locate the target, a laser generating device is usually affixed onto the telescopic sight so that when it is actuated by the shooter, a laser beam is generated which propagates toward the target. A laser indicator, such as a color dot, is formed on the target. The shooter will then be sure that the gun is pointed toward the target and he or she may perform the shooting accordingly.

A major problem with conventional gun and telescopic sight as mentioned above is that the laser generated is mounted outside the scope body so that it is impossible for the laser indicator and the accurate reflect the position of the targeted point. In other words, there exists a substantial clearance between the laser indicator and the real point of target. This may cause shooting inaccurate.

Moreover, since the laser generating device must be mounted onto the telescopic sight before a shooter may aim a target by using laser beam. This results in cumbersome assembling procedures before shooting, and troublesome disassembling procedures after shooting.

SUMMARY OF THE PRESENT INVENTION

The invention is advantageous in that it provides a telescopic sighting device which allows a user to directly observe a laser indicator through an ocular lens so as to maximize the accuracy of targeting an object.

Another advantage of the invention is to provide a telescopic sighting device which minimize a distance between the laser indicator and the target of shooting so as to maximize the accuracy of that shooting.

Another advantage of the invention is to provide a telescopic sighting device, wherein the laser locator is mounted within a tubular scope so as to eliminate assembling and disassembling procedures associated with above-mentioned conventional telescopic sight.

Another advantage of the invention is to provide a telescopic sighting device which greatly enhances the accuracy of the shooting by having a laser locator optimally working with other parts of the telescopic sight.

Additional advantages and features of the invention will become apparent from the description which follows, and may be realized by means of the instrumentalities and combinations particular point out in the appended claims.

According to the present invention, the foregoing and other objects and advantages are attained by providing a telescopic sighting device, comprising:

a tubular scope defining a bell portion, a body portion and an eyepiece portion, wherein the tubular scope has a receiving cavity formed along the bell portion, the body portion and the eyepiece portion;

an objective lens mounted at the bell portion of the tubular scope for focusing light at a focal point in the body portion of the tubular scope;

an ocular assembly comprises a ocular lens provided at the eyepiece portion of the tubular scope for magnifying the light from the focal point; and a laser locator which is mounted at the bell portion of the tubular scope at a position adjacent to the objective lens, and comprises a laser emitter arranged to generate a laser beam toward a target, in such a manner that a user is able to observe a laser indicator produced by the laser beam on the target through the ocular assembly so as to enhance an accuracy of locating the target by the telescopic sighting device.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
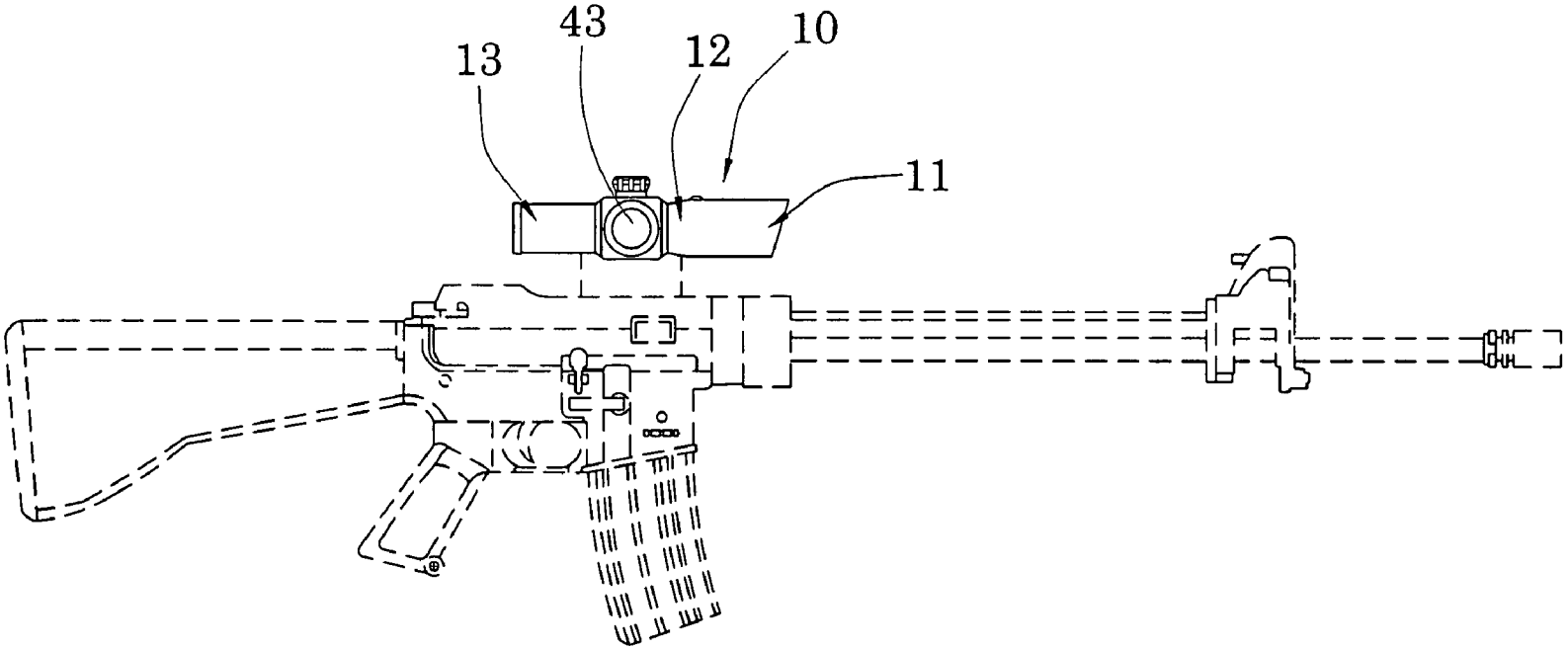
FIG. 1 is a side view of a telescopic sighting device according to a preferred embodiment of the present invention.
Figure 2:
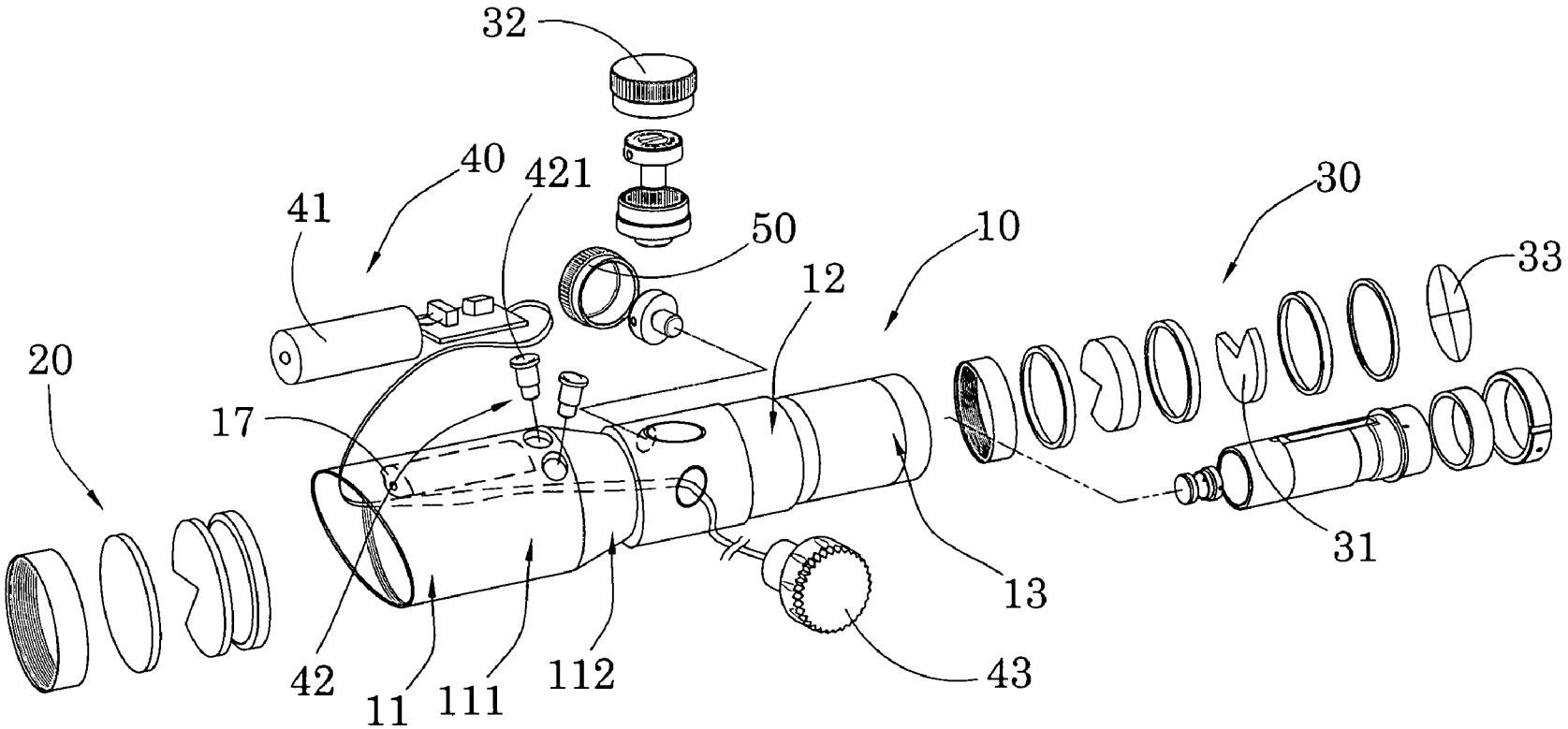
FIG. 2 is an exploded perspective view of the telescopic sight device according to the above preferred embodiment of the present invention.
Figure 3:
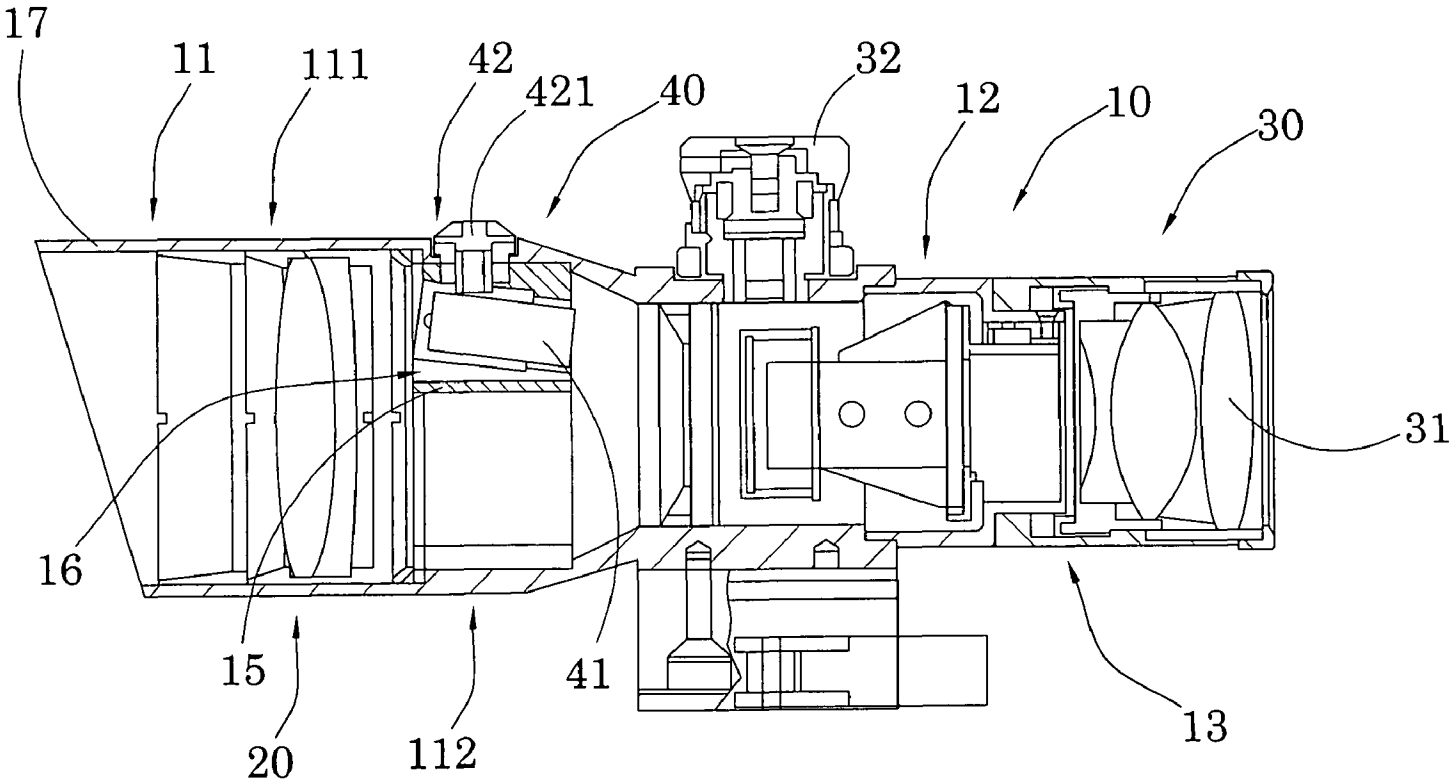
FIG. 3 is a sectional side view of the telescopic sight device according to the above preferred embodiment of the present invention.
Figure 5:
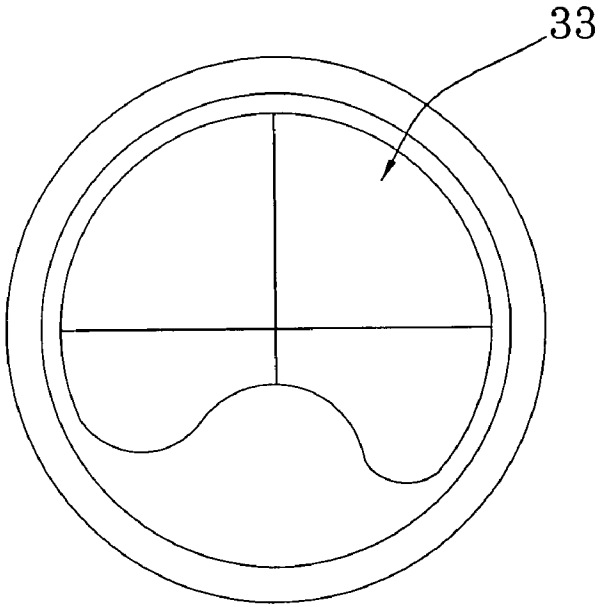
FIG. 5 is a rear view of the telescopic sight device according to the above preferred embodiment of the present invention.
Figure 4:
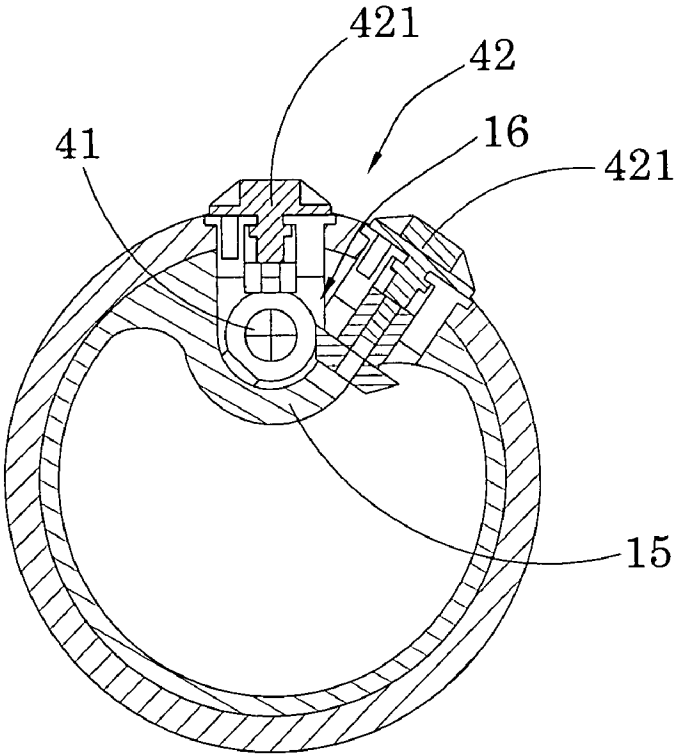
FIG. 4 is a front view of the telescopic sight device according to the above preferred embodiment of the present invention.
Figure 6:
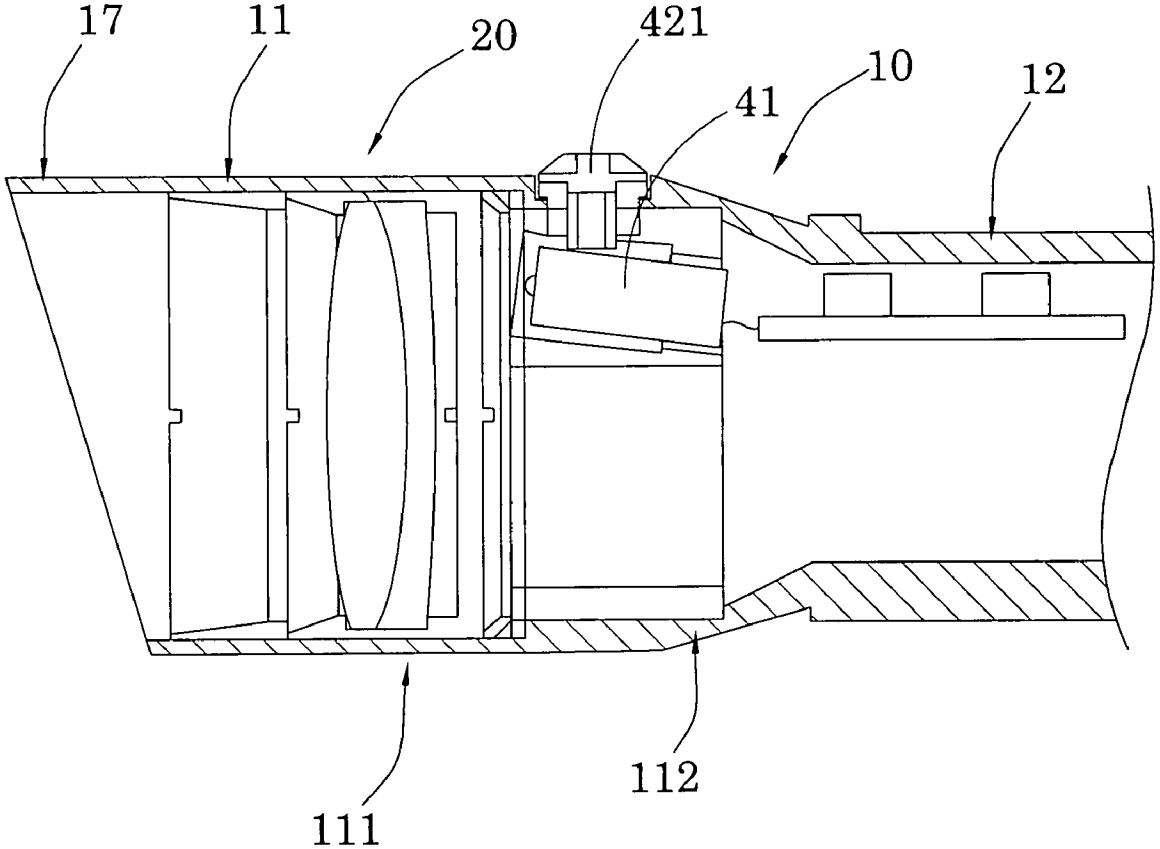
FIG. 6 is a rear view of the telescopic sight device according to the above preferred embodiment of the present invention.

Referring to FIG. 1 to FIG. 6 of the drawings, a telescopic sighting device according to a preferred embodiment of the present invention is illustrated, in which the telescopic sighting device comprises a tubular scope 10, an objective lens 20, an ocular assembly 30, and a laser locator 40. The telescopic sighting device is for mounting onto a gun so as to facilitate accurate shooting from a shooter operating the gun.

The tubular scope 10 defines a bell portion 11, a body portion 12 and an eyepiece portion 13, wherein the tubular scope 10 has a receiving cavity 14 formed along the bell portion 11, the body portion 12 and the eyepiece portion 13. On the other hand, the objective lens 20 is mounted at the bell portion 11 of the tubular scope 10 for focusing light at a focal point in the body portion 12 of the tubular scope 10.

The ocular assembly 30 comprises at least one ocular lens 31 provided at the eyepiece portion 13 of the tubular scope 10 for magnifying the light from the focal point. The laser locator 40 is mounted at the bell portion 11 of the tubular scope 10 at a position adjacent to the objective lens 20, and comprises a laser emitter 41 arranged to generate a laser beam toward a target, in such a manner that a user is able to observe a laser indicator produced by the laser beam on the target through the ocular assembly 30 so as to enhance an accuracy of locating the target by the telescopic sighting device.

According to a preferred embodiment of the present invention, the tubular scope 10 is elongated in shape and has a circular cross section in which a diameter of the bell portion 11 is slightly larger than that of the body portion 12. The eyepiece portion 13 has a diameter substantial the same as that of the body portion 12. Furthermore, the tubular scope 10 further comprises a shading piece 17 integrally extended from a front side of the bell portion 11 preventing lighting from distracting the normal vision of a target spot.

The objective lens 20 is mounted in the bell portion 11 of the tubular scope 10 and is arranged to transmit and focus light from an exterior of the tubular scope 10 to the ocular assembly 30. It is the first optical element which modifies light coming from an exterior of the tubular scope 10. The bell portion 11 of the tubular scope 10 is divided into a front section 111 and a contracted rear portion 112 in which a diameter thereof is gradually decreasing from the front section toward the body portion 12 of the tubular scope 10.

The ocular lens 31 of the ocular assembly 30 is provided at the eyepiece portion 13 of the tubular scope 10 for magnifying the image captured by the objective lens 20. As such, the shooter is able to telescopically observe the target at a distance and perform shooting from a position far away from where the target is positioned. In this preferred embodiment, the ocular assembly 30 comprises a plurality of ocular lens 31 spacedly mounted in the eyepiece portion 13 for optimally magnifying the image captured by the objective lens 20.

The ocular assembly 30 further comprises an adjustment ring 32 movably provided on the tubular scope 10 for allowing the shooter to adjust the magnifying parameters of the ocular assembly 30. The adjustment ring 32 is rotatably provided on the tubular scope 10 in such a manner that when the adjustment ring 32 is rotated, the magnifying power of the ocular assembly 30 is adjusted to fit the shooter's need. Furthermore, them ocular assembly 30 further comprises a reticle 33 mounted in the eyepiece portion 13 of the tubular scope 10 for assisting the shooting to precisely locate the target. The reticle 33 thus defines a horizontal and a vertical guiding grid for particularly pinpointing the targeted object.

Furthermore, the tubular scope 10 further comprises a utility partition 15 formed in the bell portion 11 to define a laser compartment 16 therein, wherein the laser emitter 41 is mounted in the laser compartment 16 for generating the laser beam toward the objective lens 20. The laser locator 40 further comprises at least one laser adjuster 42 provided on the bell portion 11 of the tubular scope 10 and is arranged to adjust a direction of the laser beam generated by the laser emitter 41. More specifically, the laser adjuster 42 comprises a plurality of adjustment knobs 421 which are movably provided on the bell portion 11 of the tubular scope 10 and are coupled with the laser emitter 41 so that when the adjustment knobs are arranged to drive the laser emitter 41 to pivotally move within laser compartment 16 so as to alter the orientation thereof. When the orientation of the laser emitter 41 is altered, the orientation of the laser will also be altered accordingly.

In order to control the operation of the laser emitter 41, the laser locator 40 further comprises a laser controller 43 mounted on the tubular scope 10, wherein the laser controller 43 comprises a laser actuator 432 operatively provided in the body portion 12 of the tubular scope 10 for selectively actuating the laser emitter 41 to generate the laser beam. More specifically, the laser actuator 432 is externally mounted on the body portion 12 of the tubular scope in a rotatably movable manner. When the shooter rotates the laser actuator 432, the laser emitter 41 is arranged to generate the laser beam at a predetermined direction so as to provide an indication of the shooting spot.

The telescopic sighting device further comprises a plurality of optical controllers 50 mounted on the tubular scope 10 for altering the optical parameters of the objective lens 20 and/or the ocular assembly 30. For example, one of the optical controllers 50 may be embodied as an elevation controller rotatably provided on the body portion 12 of the tubular scope 10 in such a manner that when the elevation controller is rotated, the position of the reticle 33 of the ocular assembly 30 is correspondingly altered.

The operation of the present invention is as follows: when the user needs to shoot, he or she may observe the target through the ocular assembly 30. At the same time, the user may need the laser locator 40 to precisely locate the target. Thus, the user may operate the laser actuator 432 to generate a laser beam toward the target. When the laser beam is generated, the user is able to observe the laser beam directly through the ocular assembly 30. After adjusting the various optical parameters using the optical controller 50, the user may launch the shooting procedure.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A telescopic sighting device, comprising:

a tubular scope defining a bell portion, a body portion and an eyepiece portion, wherein said tubular scope has a receiving cavity formed along said bell portion, said body portion and said eyepiece portion;

an objective lens mounted at said bell portion of said tubular scope for focusing light at a focal point in said body portion of said tubular scope;

an ocular assembly comprises a ocular lens provided at said eyepiece portion of said tubular scope for magnifying said light from said focal point; and a laser locator which is mounted at said bell portion of said tubular scope at a position adjacent to said objective lens, and comprises a laser emitter arranged to generate a laser beam toward a target, in such a manner that a user is able to observe a laser indicator produced by said laser beam on said target through said ocular assembly so as to enhance an accuracy of locating said target by said telescopic sighting device.

2. The telescopic sighting device, as recited in claim 1, wherein said ocular assembly further comprises an adjustment ring movably provided on said tubular scope for allowing said shooter to adjust magnifying parameters of said ocular assembly, wherein said ocular assembly further comprises a reticle is mounted in said eyepiece and defines a horizontal and a vertical guiding grid for particularly pinpointing said target.

3. The telescopic sighting device, as recited in claim 2, wherein said tubular scope further comprises a utility partition formed in said bell portion to define a laser compartment therein, wherein said laser emitter is mounted in said laser compartment for generating said laser beam toward said objective lens.

4. The telescopic sighting device, as recited in claim 2, wherein said laser locator further comprises at least one laser adjuster provided on said bell portion of said tubular scope and is arranged to adjust a direction of said laser beam generated by said laser emitter.

5. The telescopic sighting device, as recited in claim 3, wherein said laser locator further comprises at least one laser adjuster provided on said bell portion of said tubular scope and is arranged to adjust a direction of said laser beam generated by said laser emitter.

6. The telescopic sighting device, as recited in claim 4, wherein said laser locator further comprises a laser controller mounted on said tubular scope, wherein said laser controller comprises a laser actuator rotatably provided on said tubular scope for selectively actuating said laser emitter to generate said laser beam.

7. The telescopic sighting device, as recited in claim 5, wherein said laser locator further comprises a laser controller mounted on said tubular scope, wherein said laser controller comprises a laser actuator rotatably provided on said tubular scope for selectively actuating said laser emitter to generate said laser beam.

8. The telescopic sighting device, as recited in claim 5, wherein said laser adjuster comprises a plurality of adjustment knobs which are movably provided on said bell portion of said tubular scope and are coupled with said laser emitter so that when said adjustment knobs are arranged to drive said laser emitter to pivotally move within said laser compartment so as to alter said orientation thereof.

9. The telescopic sighting device, as recited in claim 6, wherein said laser adjuster comprises a plurality of adjustment knobs which are movably provided on said bell portion of said tubular scope and are coupled with said laser emitter so that when said adjustment knobs are arranged to drive said laser emitter to pivotally move within said laser compartment so as to alter said orientation thereof.

10. The telescopic sighting device, as recited in claim 7, wherein said laser adjuster comprises a plurality of adjustment knobs which are movably provided on said bell portion of said tubular scope and are coupled with said laser emitter so that when said adjustment knobs are arranged to drive said laser emitter to pivotally move within said laser compartment so as to alter said orientation thereof.

11. The telescopic sighting device, as recited in claim 5, wherein said ocular assembly comprises a plurality of ocular lens spacedly mounted in said eyepiece portion for optimally magnifying said image captured by said objective lens.

12. The telescopic sighting device, as recited in claim 7, wherein said ocular assembly comprises a plurality of ocular lens spacedly mounted in said eyepiece portion for optimally magnifying said image captured by said objective lens.

13. The telescopic sighting device, as recited in claim 10, wherein said ocular assembly comprises a plurality of ocular lens spacedly mounted in said eyepiece portion for optimally magnifying said image captured by said objective lens.

14. The telescopic sighting device, as recited in claim 7, further comprising a plurality of optical controllers mounted on said tubular scope for altering said optical parameters of said objective lens and said ocular assembly.

15. The telescopic sighting device, as recited in claim 10, further comprising a plurality of optical controllers mounted on said tubular scope for altering said optical parameters of said objective lens and said ocular assembly.

16. The telescopic sighting device, as recited in claim 13, further comprising a plurality of optical controllers mounted on said tubular scope for altering said optical parameters of said objective lens and said ocular assembly.

17. The telescopic sighting device, as recited in claim 10, wherein said bell portion of said tubular scope is divided into a front section and a contracted rear portion in which a diameter thereof is gradually decreasing from said front section toward said body portion of said tubular scope.

18. The telescopic sighting device, as recited in claim 13, wherein said bell portion of said tubular scope is divided into a front section and a contracted rear portion in which a diameter thereof is gradually decreasing from said front section toward said body portion of said tubular scope.

19. The telescopic sighting device, as recited in claim 16, wherein said bell portion of said tubular scope is divided into a front section and a contracted rear portion in which a diameter thereof is gradually decreasing from said front section toward said body portion of said tubular scope.

20. The telescopic sighting device, as recited in claim 19, wherein said tubular scope is elongated in shape and has a circular cross section in which a diameter of said bell portion is slightly larger than that of said body portion, wherein a diameter of said eyepiece portion is substantially the same as that of said body portion.

* * * * *